US007028510B1

(12) United States Patent
DaRosa

(10) Patent No.: US 7,028,510 B1
(45) Date of Patent: Apr. 18, 2006

(54) KNITTED WIRE CARRIER WITH LOCKING STITCH FOR WEATHER SEAL BACKING

(75) Inventor: Charles DaRosa, Riverside, RI (US)

(73) Assignee: NFA Corporation, Cumberland, RI (US)

( * ) Notice: Subject to any disclaimer, the term of this patent is extended or adjusted under 35 U.S.C. 154(b) by 0 days.

(21) Appl. No.: 11/188,506

(22) Filed: Jul. 25, 2005

(51) Int. Cl.
*D04B 7/14* (2006.01)

(52) U.S. Cl. ..... 66/190; 66/170

(58) Field of Classification Search ..... 66/190, 66/192, 193; 428/111, 107; 442/307, 310, 442/313, 314, 316
See application file for complete search history.

(56) References Cited

U.S. PATENT DOCUMENTS

| | | | | |
|---|---|---|---|---|
| 3,238,689 | A | 3/1966 | Cook, Jr. | |
| 4,343,845 | A | 8/1982 | Burden et al. | |
| 4,413,033 | A | 11/1983 | Weichman | |
| 4,624,093 | A * | 11/1986 | Gibson | 52/717.05 |
| 4,748,078 | A | 5/1988 | Doi et al. | |
| 5,072,567 | A | 12/1991 | Cook et al. | |
| 5,143,666 | A * | 9/1992 | McManus et al. | 264/472 |
| 5,204,157 | A | 4/1993 | Matsumiya | |
| 5,416,961 | A | 5/1995 | Vinay | |
| 5,902,956 | A * | 5/1999 | Spies et al. | 174/35 GC |
| 6,150,003 | A | 11/2000 | McCutchan, Jr. | |
| 6,214,267 | B1 * | 4/2001 | Keys | 264/171.16 |
| 6,219,906 | B1 * | 4/2001 | Sosnowski | 29/825 |
| 6,461,713 | B1 | 10/2002 | King | |
| 6,761,954 | B1 | 7/2004 | Hauser | |

* cited by examiner

*Primary Examiner*—Danny Worrell
(74) *Attorney, Agent, or Firm*—Cesari and McKenna, LLP; William A. Loginov

(57) ABSTRACT

This provides a knitted wire carrier that incorporates a locking stitch that passes through the warp threads adjacent to the wire weft. In one embodiment, the locking stitch constructed from a "heat-activated yarn" consisting of an underlying material having exhibiting minimal shrinkage under application of heat and an outer heat-activated adhesive coating that fuses to the warp and wire weft when heated. In another embodiment, the locking stitch is constructed from a composite yarn having at least one meltable thread and a plurality of shrink-resistant threads braided together so as to avoid distorting shrinkage upon heating to melt and fuse the meltable thread.

17 Claims, 3 Drawing Sheets

KNITTED WIRE CARRIER WITH LOCKING STITCH FOR WEATHER SEAL BACKING

BACKGROUND OF THE INVENTION

1. Field of the Invention

This invention relates to wire carriers having a knitted stitching used as backing for elastomeric weather seals in automotive and other applications.

2. Background Information

Knitted wire carriers are commonly used in the area of automotive weather seals, among other uses. Generally, such carriers consist of a continuous wire weft formed into a zigzag pattern with rounded ends. The ends join together a series of approximately parallel weft segments (limbs) upon which a plurality of warp threads are knitted. This type of knitted wire carrier is used as a reinforcing frame for elastomeric seals that are produced by extrusion and other continuous-forming processes. Such seals are often used in automotive and other vehicle applications.

The manufacture of extruded weather seals involves the application of substantial forming heat and pressure to the wire carrier. The warp threads in many examples is applied in three clusters or strips, all of which are designed to maintain the zigzag wire weft the appropriately spaced orientation during the formation process. Absent these warp threads, the wire would tend to stretch and deform, generating an inferior or unusable finished seal product. However, even where a plurality of clustered warp threads are firmly knitted to a zigzag wire weft, problems may still arise during seal formation. The flow of elastomeric seal material and the basic motion of the knitted wire carrier through the formation machinery may cause the warp threads to migrate along the weft at various points. Thus, the end-mounted warp becomes misaligned and migrates inward toward the center while a centrally mounted warp (where used) may migrate to the side.

One approach for dealing with the problem of warp migration along the weft wire is to coat the entire knitted structure in polymer prior to seal extrusion. Besides the added cost of an additional manufacture step, this approach is disadvantaged in that it generates a less flexible structure in which the polymer coating may flake off (due to flexure of the carrier) during or after seal formation. These flakes can dirty or damage the seal-forming machinery, among other disadvantages.

Another approach to securing warp threads against migration along the wire is described in U.S. Pat. No. 5,416,961 entitled KNITTED WIRE CARRIER HAVING BONDED WARP THREADS AND METHOD FOR FORMING SAME, by Paul M. Vinay the teachings of which are expressly incorporated herein by reference. This patent teaches the use of a meltable or shrinkable filament, formed entirely of a material such as polypropylene, which melts to the carrier and/or shrinks to draw the warp filaments tightly together upon application of heat. However, using such a filament subjects the warp and carrier to significant shrinkage and may tend to deform the knitted structure, particularly after continued application of heat.

Accordingly, it is desirable to provide a knitted wire carrier that limits or eliminates the possibility of warp migration along the wire, but does not exhibit distorting or deforming levels of shrinkage.

SUMMARY OF THE INVENTION

This invention overcomes the disadvantages of the prior art by providing a knitted wire carrier that incorporates a locking stitch that passes through the warp threads adjacent to the wire weft. In one embodiment, the locking stitch constructed from a "heat-activated yarn" consisting of an underlying material having exhibiting minimal shrinkage under application of heat and an outer heat-activated adhesive coating that fuses to the warp and wire weft when heated. In another embodiment, the locking stitch is constructed from a composite yarn having at least one meltable thread and a plurality of shrink-resistant threads braided together so as to avoid distorting shrinkage upon heating to melt and fuse the meltable thread.

In one embodiment, the internal threads of the heat-activated yarn can be composed of polyester and the adhesive coating can be a polyolefin (EVA). Likewise, the shrink resistant threads of the composite yarn can be polyester while the meltable thread can be polypropylene. In one embodiment, the wire weft can define a somewhat propeller-shaped outline with central regions that are closer together than the rounded-over segments nearer to the opposing ends. In another embodiment, the weft segments or limbs can be substantially parallel across their entire widths between rounded over ends.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
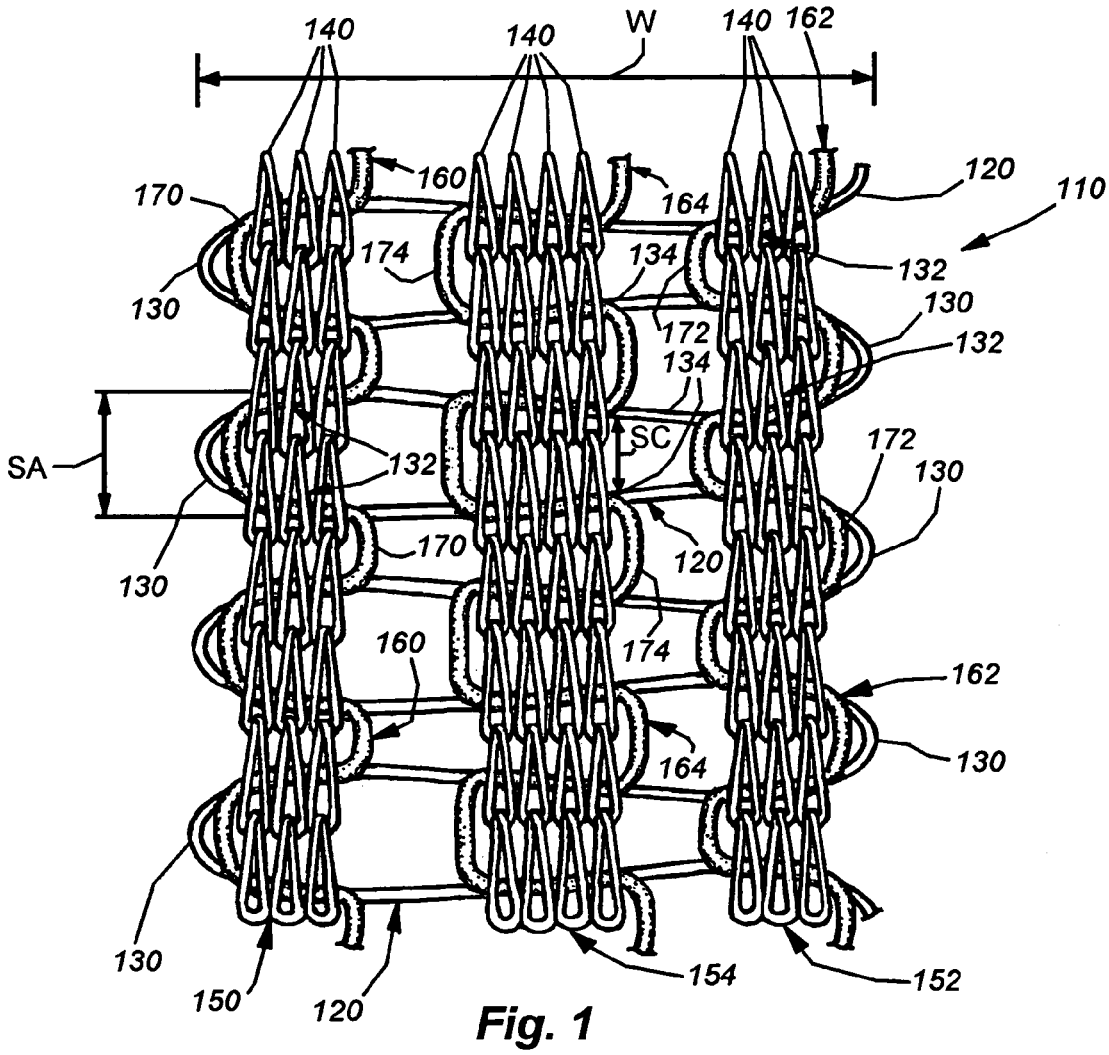
FIG. 1 is a fragmentary plan view of a knitted wire carrier with locking stitches composed of heat-activated yarn according to an embodiment of this invention.

A segment knitted wire carrier 110 according to an embodiment of this invention is shown in FIG. 1. This carrier 110 consists of a zigzag bent wire 120. This wire can be constructed from a variety of deformable materials. For example the wire 120 can be low-carbon steel, galvanized steel or aluminum alloy having a diameter of between approximately 0.025 and 0.035 inch. In certain embodiments, the wire 120 can be coated with an anti-rust/anti-corrosion coating or plating. When manufactured, the wire is bent generally in a planar fashion, and is formed into a continuous strip. The strip has a generally constant width W between the bend apices 130 on each opposing side. In one example, that width W is approximately 1¼–1⅝ inches. However, the width of the wire carrier is widely variable depending, in part, upon the selected application for which it is used.

The bent wire 120 essentially defines the weft, about which a series of warp yarns 140 are knitted. These warp yarns, as discussed above, maintain the relative shape and spacing of the bent wire segments and provide a further substrate for elastomeric/polymeric weather seal material (not shown) to adhere to the carrier 110. In this example, the warp yarns are divided into three discrete clusters. There are two edge warp clusters 150 and 152 of approximately three yarns (in this example) adjacent to each of the sides, near the bend apices 130. There is also a central warp cluster 154 of approximately four yarns (in this example) disposed along the approximate center of the strip's width. In this embodiment, the yarns are constructed from polyester with a Denier of approximately 1000 and between approximately 140–300 filaments. Note that this specification for warp years is only exemplary and that a wide range of materials, Denier and filament counts are expressly contemplated.

In this embodiment, the wire's bend apices 130 are connected to curved wire bend segments 132 that define a wider spread SA therebetween than the spread SC between adjacent central wire segments 134. By having a wider spread between adjacent wires near the ends than in the center, the carrier defines the general outline appearance of a "propeller" blade. This conventional shape is used in part, to maintain the edge warps 150 and 152 near or at the apices since they must "climb over" the widened spread between segments 132 to creep into the middle. Nevertheless, the edge warps still tend to move in prior art arrangements and the central warp 154 is also free to creep or slide along the width of the carrier in such arrangements.

To control and eliminate sliding of the warps 150, 152 and 154 along the wire 120 this embodiment provides a respective locking stitch 160, 162 and 164. The locking stitch 160, 162 and 164 passes through each warp in proximity to the wire 120. It the bridges the warp via a respective bridging segment 170, 172 and 174 that crosses between wires along each of opposing sides of the respective warp cluster 150, 152, 154. The locking stitch, itself, follows a zigzag pattern along the respective warp as shown—alternating between each of opposite sides of the respective warp cluster along the length of the carrier. The orientation of the zigzag, with respect to each cluster can vary. In other words, as shown in FIG. 1, all three locking stitch bridging segments 170, 172 and 174 are oriented in the same direction and on the same side of the respective warp between a given pair of adjacent segments. In alternate embodiments, the bridging segments of one or more locking stitches can be oriented on an opposite side with respect to the bridging segments of one of the locking stitches.

Figure 2:
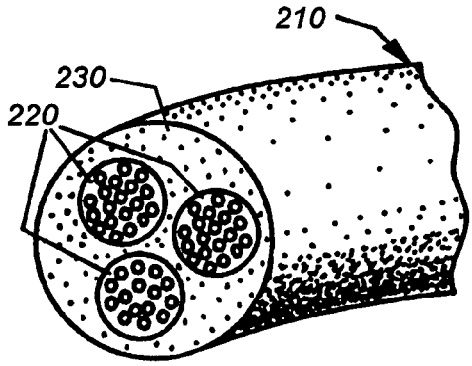
FIG. 2 is a somewhat schematic cross-sectional perspective view of a segment of heat-activated yarn for use in the embodiment of FIG. 1.

The locking stitches 160, 162 and 164 each comprise a heat-activated yarn in this embodiment. A schematic illustration of this yarn 210 is shown in FIG. 2. This yarn 210 consists of a bundle of braided or twisted filaments 220 that are covered by a casing 230 of thermally activated adhesive. In one embodiment, the filaments are polyester and the filament count is between approximately 34 and 200. The yarn has a Denier of 150–500.

The adhesive casing 230 is composed of a meltable/fusible polymer such as conventional EVA (also known for its use in "hot-melt" glues. The adhesive has a melt temperature of approximately 200–250 degrees F. and a dwell time of between approximately 30–90 seconds. It is expressly contemplated that other compositions, materials and melt specifications can be employed. For the purposes of this description, the term "heat-activated yarn" shall refer generally to a yarn having (low) shrinkage characteristics similar to polyester fibers and a coating of meltable/fusible material that runs and adheres to a surface in response to application of moderately elevated heating that is otherwise insufficient to undesirably damage the warp yarn or internal filaments of the heat-activated yarn itself.

In the embodiment of FIG. 1, the locking stitches 160, 162 and 164 are applied during the knitting process using a weft insertion bar of conventional design on the knitting machine that knits the warp 150, 152 and 154 to the carrier wire 120. The process should be known to those of ordinary skill in the art. After the carrier is knitted, it is directed to a heat source that provides the requisite level of heat so as to elevate the adhesive casing to the desired melting temperature, above. The heat source can comprise a variety of mechanisms that transmit heat to the carrier. In one embodiment, the heat source comprises an inline contact-heating plate that engages a section of the carrier for a predetermined time duration to effect melting. Alternatively, the heat source can comprise an inline infra red heating oven that transmits heat to the wire carrier and thereby causes requisite melting. After passage through the heat source, the carrier section is allowed to cool and thereby solidify the adhesive in a new, flowed state in which the adhesive fuses to and joins the adjacent warp to the wire weft. Because of the relatively contactless arrangement and wide area of transmission, infra red heating is preferred in certain embodiment. However a variety of heat sources are expressly contemplated.

Note that while a locking stitch 160, 162 and 164 is provided to each individual warp cluster 150, 152 and 154, it is expressly contemplated that a locking stitch may be provided to only some of the warp clusters herein. For example, the end warps 150, 152 may be locked, while the central warp 154 may be unlocked. Likewise, while the locking stitches are woven individually into each of the warps, individually, it is expressly contemplated that one locking stitch may be passed through a plurality of warp clusters in alternate embodiments. Likewise, the individual warp yarns in a given cluster may each be locked by one of a plurality of locking stitches in alternate embodiments. In other words, multiple locking stitches may be provided to a given warp cluster.

Figure 3:
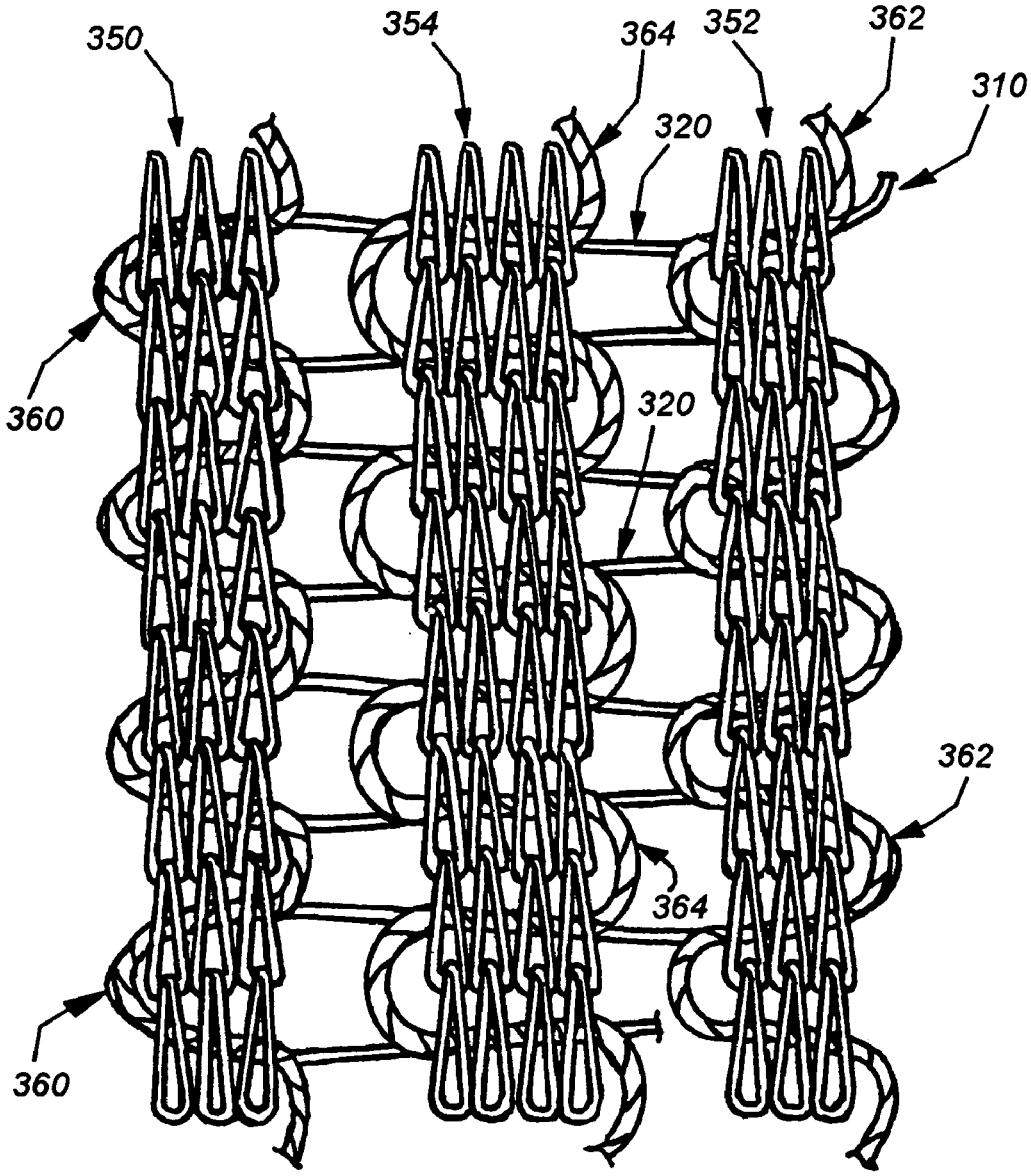
FIG. 3 is a fragmentary plan view of a knitted wire carrier with locking stitches composed of a composite yarn according to an embodiment of this invention.
Figure 4:
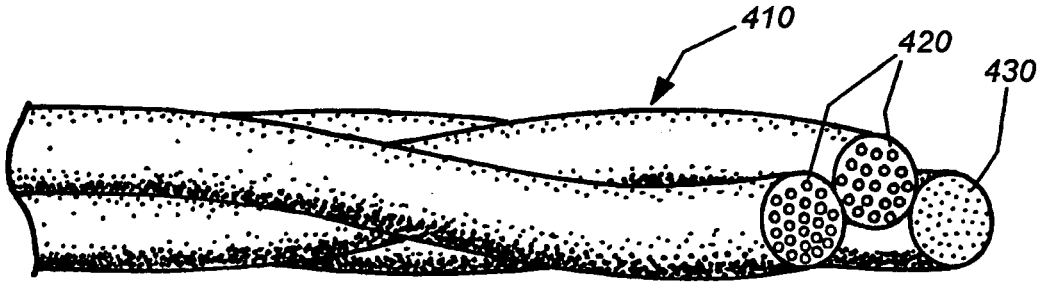
FIG. 4 is a somewhat schematic cross-sectional perspective view of a segment of composite yarn for use in the embodiment of FIG. 3.

While a heat-activated yarn provides a highly effective licking stitch, an alternate embodiment using a non-heat-activated yarn, according to an embodiment of this invention is shown in FIG. 3. In this embodiment, the wire carrier 310 comprises a zigzag-bent (propeller-shaped) wire 320 that has two end warp clusters 350 and 352 and a central warp cluster 354 knitted thereover. The overall structure of the carrier 310 is substantially similar to that described above for the embodiment of FIG. 1. This structure differs in that the locking stitch 360, 362 and 364 associated with each respective warp cluster 350, 352 and 354 is composed of a composite yarn that has both shrink/melt-resistant characteristics and a fusible/meltable component that secures the adjacent warp to the wire weft. More particularly, a segment of the composite yarn 410 is shown somewhat schematically in FIG. 4. The yarn 410 consists of twisted or cabled bundles of filaments in which a majority of the filament bundles 420 are composed of a low-shrinkage, higher melting-temperature material such as polyester. A bundle 430 of lower-melting temperature filaments is provided within the overall yarn structure 410. This bundle is constructed from a meltable/fusible/shrinkable fiber material such as polypropylene. In general, both types of fibers in the composite yarn 410 contribute to an over Denier of between approximately 300–2000 in this embodiment. There are between 200–400 total filaments in this embodiment. Approximately one-third of the filaments are composed of the polypropylene (or another material with similar properties). Where a composite yarn as described generally above is employed as the lock stitch 360, 362 and/or 364, the procedures for manufacture are similar to those for the embodiment of FIG. 1 above. The heating temperature is between approximately 325 and 375 degrees F. in one embodiment and the dwell time is between approximately 30–90 seconds. Note that it is expressly contemplated that both composite and heat-activated yarns (and/or other locking techniques) can be used together in the same wire carrier in alternate embodiments.

For the purposes of this description, the term "composite yarn" can be defined as a yarn having at least some fusible/meltable/shrinkable filaments at a predetermined temperature and some substantially non-fusible/meltable/shrinkable filaments at the same predetermined temperature. While both sets of filaments may exhibit shrinkage and melting at the given temperature, the effect is significantly more pronounced, and leads to the desired effect primarily in the fusible/meltable/shrinkable filaments. The other filaments act, conversely, to moderate the effect.

In practice, the composite yarn, upon heating exhibits some degree of shrinkage and some degree of flow via melting so that it fuses to the warp and to the wire and also pulls the warps in a given cluster together. After cooling, the structure is more-tightly bound to the wire, but the use of polyester in the overall composite matrix of the yarn prevents uncontrolled shrinkage that would tend to deform the carrier.

The use of a composite yarn also allows for additional manufacture steps in certain circumstances. For example, in certain manufacturing processes, additional heating steps may be applied after initial formation of the wire carrier, such heating steps may be before or during application of elastomeric seal material to the carrier. The heat-activated yarn may be overheated by such processes or less-desirable, than a composite thread that may form a more-secure structure due to its ability to absorb multiple heating steps. Similarly, in an alternate manufacture process, the composite yarn may remain unheated until just before application of seal elastomer. In this process, heat is applied, the yarn partially melts and elastomer is then applied. The entire finished weather seal unit is then allowed to cool.

Figure 5:
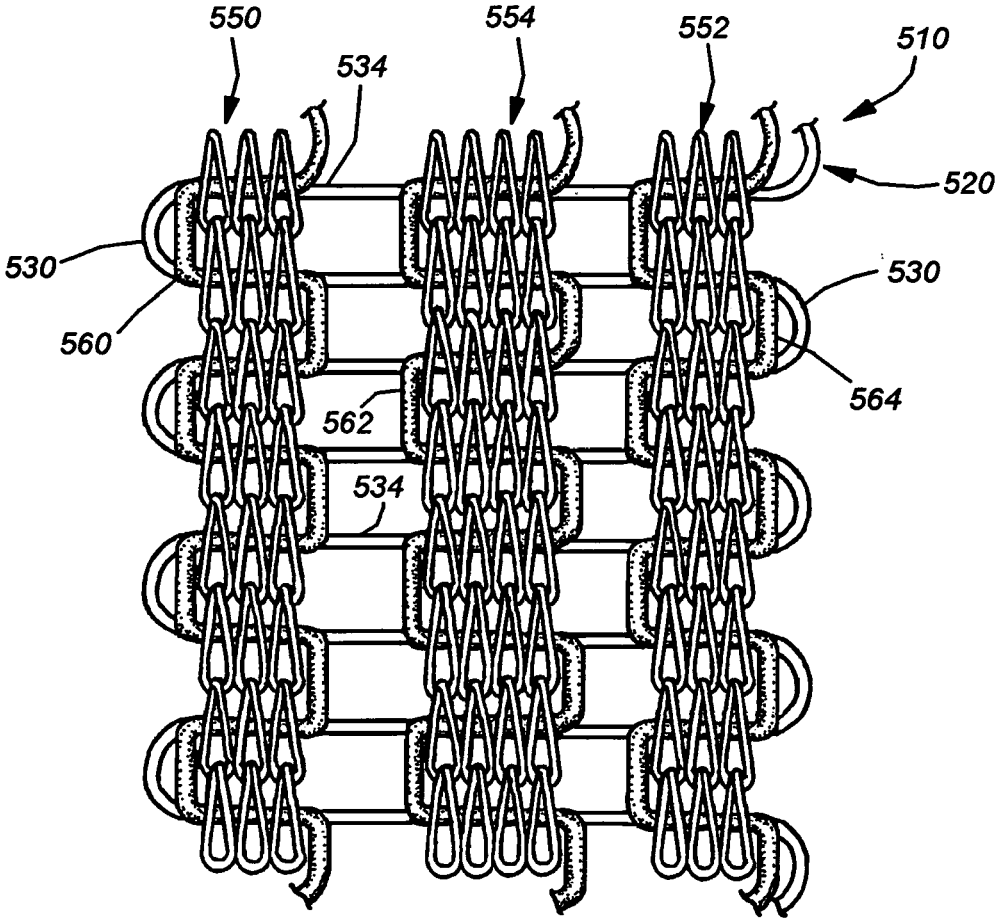
FIG. 5 is a fragmentary plan view of a knitted wire carrier with locking stitches composed of either a composite yarn or heat-activated yarn having parallel wire limbs according to an embodiment of this invention.

FIG. 5 details another embodiment of this invention in which the wire carrier 510 includes a zigzag-bent wire 520 consisting of 180-degree rounded over ends 530 and parallel central segments 534. Thus, this arrangement lacks the propeller-shape of the previous embodiments (FIG. 1 and FIG. 3). Such a structure may be desirable in certain applications where the carrier strip is cut evenly across the width and the propeller shape may cause the central segment to be severed in two locations (owing to its non-parallel orientation). This can be undesirable, as it leaves an unconnected "island" of wire on one of the severed ends. In the arrangement of FIG. 5, the wire is always cut at only one point, so long as it is cut along its length somewhere between segments 534.

In the embodiment of FIG. 5, the wire 520 acts as the weft for three warp clusters 550, 552 and 554 as described generally above. A respective locking stitch 560, 562 and 564 is directed through the warp 550, 552 and 554. This warp can be composed of either (or both) a heat-activated or composite yarn as described above. The associated manufacturing processes for producing the carrier and seal follow one of the described set of steps above. The use of a locking stitch on the end warps 550 and 552 is particularly advantageous in this embodiment because there is no widened end region (spacing SA) to resist movement of the end warps 550 and 552 toward the center. The locking stitch provides such resistance.

The foregoing has been a detailed description of various embodiments of the invention. Modifications and additions can be made to this description without departing from the spirit and scope thereof. For example, the shape of the bent wire can take any of a variety of zigzag shapes that are either constant in width and lengthwise spacing (between adjacent segments) or variable. It is expressly contemplated that any of the wire arrangements herein can be used with any type of locking stitch yarn described herein, or that a combination of yarn types can be employed in a single carrier. Likewise, the number of yarns in a given warp cluster are highly variable as are the number of warp clusters and their location(s) along the width of the carrier. Also, it is contemplated that in further embodiments, adhesive coatings and/or low-shrinkage, fusible yarns can be provided to one or more of the warp yarns to work in conjunction with the locking stitch. Finally, it is expressly contemplated that additional seal manufacturing steps, such as an application of a coating to the carrier prior to application of seal material can be carried out in alternate embodiments.

What is claimed is:

1. A knitted wire carrier comprising:

a wire bent into a zigzag orientation of segments joined by bends so as to define a length of extension and a width;

a warp knitted along the length around the segments; and a heat-activated yarn, the heat-activated yarn comprising a bundle of filaments covered in a meltable adhesive, the heat-activated yarn passing through the warp in engagement with the wire and being adhesively joined to each of the segments and warp by the melted adhesive, the adhesive adapted to melt by a predetermined heat and the filaments and warp each adapted to remain substantially unmelted by the predetermined heat.

2. The knitted wire carrier as set forth in claim 1 wherein the heat-activated yarn comprises a bundle of polyester filaments covered with the meltable adhesive.

3. The knitted wire carrier as set forth in claim 2 wherein the warp comprises a plurality of polyester-filament yarns provided in a cluster along predetermined portions of the width of the wire.

4. The knitted wire carrier as set forth in claim 3 wherein the predetermined portions include each of opposing widthwise ends of the wire.

5. The knitted wire carrier as set forth in claim 4 wherein the predetermined portions further include a central portion of the wire between opposing widthwise ends.

6. The knitted wire carrier as set forth in claim 4 wherein the wire defines a propeller blade shape.

7. The knitted wire carrier as set forth in claim 4 wherein the segments are approximately parallel to each other and are joined by approximately 180 degree bends therebetween.

8. A knitted wire carrier comprising:

a wire bent into a zigzag orientation of segments joined by bends so as to define a length of extension and a width;

a warp knitted along the length around the segments; and a composite yarn having at least some fusible/meltable/shrinkable filaments at a predetermined temperature and some substantially non-fusible/meltable/shrinkable filaments at the predetermined temperature passing through the warp in engagement with the wire and being adhesively joined to each of the segments and warp.

9. The knitted wire carrier as set forth in claim 8 wherein the composite comprises a bundle of polyester filaments and a bundle of polypropylene filaments.

10. The knitted wire carrier as set forth in claim 9 wherein the warp comprises a plurality of polyester-filament yarns provided in a cluster along predetermined portions of the width of the wire.

11. The knitted wire carrier as set forth in claim 10 wherein the predetermined portions include each of opposing widthwise ends of the wire.

12. The knitted wire carrier as set forth in claim 11 wherein the predetermined portions further include a central portion of the wire between opposing widthwise ends.

13. The knitted wire carrier as set forth in claim 12 wherein the wire defines a propeller blade shape.

14. The knitted wire carrier as set forth in claim 12 wherein the segments are approximately parallel to each other and are joined by approximately 180 degree bends therebetween.

15. A method for forming a knitted wire carrier having a wire bent into a zigzag orientation of segments joined by bends so as to define a length of extension and a width, and a warp knitted along the length around the segments, comprising the steps of:

inserting a locking stitch composed of a heat-activated yarn, with a bundle of filaments and an adhesive coating covering the filaments, through the warp in engagement with the wire; and applying a predetermined heat to cause the adhesive coating in the heat-activated yarn to melt and fuse to each of the warp and the wire while the bundle of filaments and the warp remains substantially unmelted at the predetermined heat.

16. A method for forming a weather seal with a wire carrier having a wire bent into a zigzag orientation of segments joined by bends so as to define a length of extension and a width, and a warp knitted along the length around the segments, comprising the steps of:

inserting a locking stitch composed of a composite yarn having at least some fusible/meltable/shrinkable filaments at a predetermined temperature and some substantially non-fusible/meltable/shrinkable filaments at the predetermined temperature through the warp in engagement with the wire; and applying a heat in conjunction with application of a weather seal material to the wire carrier to cause the fusible/meltable/shrinkable filaments to fuse, melt and shrink with respect to the warp and the wire.

17. The method as set forth in claim 16 further comprising the step of, before the step of applying, initially heating the composite yarn to cause the fusible/meltable/shrinkable filaments to fuse, melt and shrink with respect to the warp and the wire and thereafter allowing the fusible/meltable/shrinkable filaments to cool.

* * * * *